US007698889B1

(12) United States Patent
Burk et al.

(10) Patent No.: US 7,698,889 B1
(45) Date of Patent: Apr. 20, 2010

(54) POROUS INSERT FOR AN EXHAUST SYSTEM OF A MARINE ENGINE

(75) Inventors: Reinhard Burk, Stillwater, OK (US); Brian R. White, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 1163 days.

(21) Appl. No.: 11/301,014

(22) Filed: Dec. 12, 2005

(51) Int. Cl.
*F01N 7/10* (2006.01)

(52) U.S. Cl. ..... 60/323; 60/299; 60/317; 60/324; 440/89 F

(58) Field of Classification Search ..... 60/299, 60/317, 320, 323, 234; 440/88, 89
See application file for complete search history.

(56) References Cited

U.S. PATENT DOCUMENTS 4,781,021 A * 11/1988 Winberg ..... 60/309
4,848,082 A 7/1989 Takahashi et al. ..... 60/285
5,212,949 A * 5/1993 Shiozawa ..... 60/298
5,234,364 A * 8/1993 Ito ..... 440/89 R
5,346,417 A * 9/1994 Isogawa ..... 440/89 R
5,488,826 A * 2/1996 Paas ..... 60/299
5,632,660 A * 5/1997 Nakase et al. ..... 440/89 R
6,035,633 A * 3/2000 Woods ..... 60/310
6,116,022 A 9/2000 Woodward ..... 60/300
6,368,726 B1 4/2002 Holpp et al. ..... 428/593
6,511,355 B1 * 1/2003 Woodward ..... 440/89 H
6,565,399 B2 * 5/2003 Nakase et al. ..... 440/89 H
6,639,193 B2 10/2003 Schaper ..... 219/603
6,660,235 B1 12/2003 Holpp et al. ..... 422/180
6,740,178 B2 5/2004 Kurth et al. ..... 148/529
6,799,422 B2 10/2004 Westerbeke et al. ..... 60/289

* cited by examiner

*Primary Examiner*—Tu M Nguyen
(74) *Attorney, Agent, or Firm*—William D. Lanyi

(57) ABSTRACT

A porous member is disposed within the exhaust stream of a marine engine at a location where its temperature approximates the temperature of the exhaust stream through normal use of the engine. Exhaust gas flows freely through the non-catalytic porous member, but water passing in a reverse direction through the exhaust system is vaporized as it attempts to flow through the non-catalytic porous member.

20 Claims, 7 Drawing Sheets

POROUS INSERT FOR AN EXHAUST SYSTEM OF A MARINE ENGINE

CROSS REFERENCE TO CO-PENDING PATENT APPLICATION

This patent application is a member of a family of and commonly owned patent applications: application Ser. No. 11/301,221, filed Dec. 12, 2005, now abandoned; application Ser. No. 11/301,015, filed Dec. 12, 2005; application Ser. No. 11/301,014, filed Dec. 12, 2005; application Ser. No. 11/301,234, filed Dec. 12, 2005; application Ser. No. 11/301,219, filed Dec. 12, 2005; application Ser. No. 11/301,218, filed Dec. 12, 2005; application Ser. No. 11/301,088, filed Dec. 12, 2005; application Ser. No. 11/299,424, filed Dec. 12, 2005; application Ser. No. 11/301,212, filed Dec. 12, 2005.

BACKGROUND OF THE INVENTION

1. Field of the Invention

The present invention is generally related to an exhaust system of a marine engine and, more particularly, to the provision of a porous member in the exhaust system to vaporize liquid water that flows in a reverse direction through the exhaust system.

2. Description of the Related Art

Those skilled in the art of internal combustion engines are aware of many types of catalyst systems that are available to improve exhaust emissions emitted by the engines.

U.S. Pat. No. 4,848,082, which issued to Takahashi et al. on Jul. 18, 1989, describes an exhaust gas purifying device for a marine engine. A catalyst exhaust system for an outboard motor is described. A throttle control arrangement is incorporated for assuring rapid heating of the catalyst to its operating temperature.

U.S. Pat. No. 4,900,282, which issued to Takahashi et al. on Feb. 13, 1990, describes an exhaust gas purifying device for a marine engine. A catalytic exhaust system for a marine outboard drive is described wherein the catalyzer material is supported by a heat conductive bracket and the bracket is cooled by a cooling jacket that is supplied with coolant from the engine cooling jacket. In one embodiment, the water jacket is cooled both internally and externally by delivering water from the cooling jacket into the exhaust system to impinge upon a wall of the cooling jacket.

U.S. Pat. No. 5,133,185, which issued to Gilbreath et al. on Jul. 28, 1992, describes an anti-moisture device for engine exhaust systems. The device is intended to remove moisture droplets from an interior surface of a duct, characterized by an outer edge secured to the interior surface of the duct, an inner edge surrounding an opening, and a connecting wall between the outer edge and the inner edge. The inner edge of the anti-moisture device is positioned closer to a downstream end of the duct than the outer edge whereby the connecting wall is positioned at an angle relative to the interior surface of the duct. Moisture droplets traveling upstream will be caught between the connecting wall and the interior surface of the duct, on the downstream side of the device.

U.S. Pat. No. 5,167,934, which issued to Wolf et al. on Dec. 1, 1992, describes a catalyzer installation for boat engines and a method for catalytic exhaust gas cleaning. The invention is intended for use in boat engines and the catalyzer is subdivided into a reduction part location upstream in the exhaust gas line and an oxidation part located coaxially downstream after it. An intermediate space is located between the reduction and oxidation parts. Both catalyzer parts are surrounded by a preferably cylindrical, water cooled casing and the casing has a downstream secondary air inlet to which a secondary air blower can be connected, the secondary air separating the very hot catalyzer from the double walled, water cooled casing and, in particular, flowing around the oxidation catalyzer part in counterflow for air preheating so that the air preheating in this manner is passed through the intermediate space into the oxidation part.

U.S. Pat. No. 5,203,167, which issued to Lassanske et al. on Apr. 20, 1993, describes a marine propulsion device internal combustion engine and method for making the same. The propulsion device comprises a driveshaft housing, a propeller shaft rotatably supported by the driveshaft housing, an internal combustion engine drivingly connected to the propeller shaft, the engine including a cylinder block defining a cylinder having an exhaust port, and defining an exhaust outlet, and an exhaust passage between the exhaust port and the exhaust outlet, an exhaust catalyst apparatus mounted on the cylinder block, the apparatus including a tongue extending into the cylinder block exhaust passage and dividing the cylinder block exhaust passage into an upstream portion communicating with the exhaust port and a downstream portion communicating with the exhaust outlet. The apparatus includes an exhaust passage communicating between the upstream portion and the downstream portion. The catalyst is located in the apparatus exhaust passage.

U.S. Pat. No. 5,212,949, which issued to Shiozawa on May 25, 1993, describes an exhaust gas cleaning system for a marine propulsion unit. It is intended for use with a watercraft engine. A plurality of horizontally positioned exhaust ports are located within an engine cylinder head. An exhaust manifold communicates with each of the exhaust ports at a first end and forms a gas collecting pipe at its second end. The second end of the gas collecting pipe is positioned above the exhaust ports. A generally horizontally positioned exhaust pipe extends from the second end of the gas collecting pipe and continues in a rearward direction. Means are provided for introducing coolant from the engine into the rearwardly extending portion of the exhaust pipe.

U.S. Pat. No. 5,306,185, which issued to Lassanske et al. on Apr. 26, 1994, describes catalytic elements for marine propulsion devices. A marine propulsion device comprising a propulsion unit including a propeller shaft, a housing including an exhaust gas inlet and an exhaust gas outlet, a catalytic element supported in the housing for reorientation from a first orientation to a second orientation different from the first orientation, and structure for reorienting the element from the first orientation to the second orientation is described.

U.S. Pat. No. 5,324,217, which issued to Mineo on Jun. 28, 1994, describes an exhaust system for a small boat. It includes a water trap device for precluding water entering the exhaust system if the watercraft becomes inverted from entering the engine through the exhaust system. Coolant from the engine is delivered to a cooling jacket that encircles the entire exhaust system and is introduced into the exhaust gases downstream of the water trap so that in the event of inversion and righting the engine coolant will also not enter the exhaust system. This also provides protection for catalyzers in the exhaust system.

U.S. Pat. No. 5,408,827, which issued to Holtermann et al. on Apr. 25, 1995, describes a marine propulsion device with improved catalyst support arrangement. An internal combustion engine includes an exhaust port, an exhaust conduit communicating with the exhaust port and having an inner surface, the conduit including first and second conduit portions having respective ends, the first and second conduit portions being connected end to end, a catalyst which is located within the conduit and which includes catalytic material and a sleeve surrounding the catalytic material, wherein the sleeve has a length and an outer surface spaced from the inner surface of the conduit along substantially the entire length of the sleeve. The sleeve has a rigid, radially outwardly extending flange captured between the ends of the conduit portions, and a flexible gasket between the flange and the end of one of the conduit portions.

U.S. Pat. No. 5,425,232, which issued to Holtermann on Jun. 20, 1995, describes a marine propulsion device with means for supplying secondary air to a catalytic converter. The marine propulsion device comprises a combustion chamber, an exhaust passage, an air pump and a three-way catalytic converter. The air pump pumps air into the exhaust passage at or immediately upstream of the catalytic converter. By this construction the internal combustion engine can be run slightly rich, but the catalytic converter will see a close to stoichiometric mixture so that the pollutants in the exhaust stream can be oxidized or reduced appropriately since the catalytic converter will be able to operate as a three-way catalytic converter.

U.S. Pat. No. 5,433,634, which issued to Nakayama et al. on Jul. 18, 1995, describes an exhaust treatment for an outboard motor. The exhaust gases are normally discharged to the atmosphere at a point below the level of the body of water in which the watercraft is operating. A catalyst bed is provided in the exhaust system and the catalyst bed is protected from damage by pumping water from the exhaust conduit in response to certain conditions. These conditions may be either rapid deceleration of the engine or watercraft, stopping of the engine, or any of the combination of sensed factors. The water is pumped by a water pump which is positioned either in the outboard drive or in the hull of an associated watercraft. The pumping of water is initiated for only a predetermined time and until the sensed condition no longer is existent.

U.S. Pat. No. 6,053,785, which issued to Kato et al. on Apr. 25, 2000, describes an exhaust system and control for a marine propulsion engine. An outboard motor exhaust system and control for insuring good running and effective exhaust gas silencing and treatment is provided. The system includes a very compact exhaust system that includes an expansion chamber formed beneath the exhaust guide plate and to which the exhaust gases are delivered and removed at optimal locations. Furthermore, a feedback control employing a combustion condition sensor is employed along with a catalyst in the exhaust. Sensors are provided upstream and downstream of the catalyst to insure that it is operating at optimum conditions.

U.S. Pat. No. 6,116,022, which issued to Woodward on Sep. 12, 2000, describes a catalytic reactor for marine applications. The reactor for an internal combustion engine has a cooling jacket surrounding multiple catalyst elements. A thermal barrier layer is formed between the catalyst elements and the cooling jacket to prevent overcooling of the catalyst elements. The thermal barrier layer can be formed from insulating elements such as fibrous material, a plurality of annular rings disposed around the catalyst elements, a corrugated layer, or can be formed by an empty space.

U.S. Pat. No. 6,368,726, which issued to Holpp et al. on Apr. 9, 2002, describes a honeycomb body configuration. It includes a honeycomb body with a fluid inlet side and a fluid outlet side. The honeycomb body is formed of at least partially structured sheet metal layers which form channels through which a fluid can flow. The honeycomb body is surrounded by an inner tubular jacket and an outer tubular jacket provided concentrically in relation thereto. The inner tubular jacket is configured as a corrugated hose in at least one axial subregion thereof. The inner tubular jacket has at least one further axis subregion which lies smoothly against the honeycomb body. The corrugated subregion and the outer tubular jacket are connected at least in a longitudinal partial region of the corrugated subregion.

U.S. Pat. No. 6,639,193, which issued to Schaper on Oct. 28, 2003, describes a method and apparatus for end-surface connection of a carrier matrix of a honeycomb body by a joining technique. It relates in particular to a catalyst carrier body. The matrix is disposed in a tubular jacket and is laminated and/or wound from at least partially structured sheet metal foils or layers. The end surface of the honeycomb body is at least partially heated with the aid of a surface inductor having induction coils.

U.S. Pat. No. 6,660,235, which issued to Holpp et al. on Dec. 9, 2003, describes a catalyst carrier configuration for installation close to an engine. It includes a housing and at least one catalyst carrier body disposed in the housing. The catalyst carrier body has partition walls defining a plurality of passages for an exhaust gas. A flange surrounds the catalyst carrier body and extends radially is outwards from the catalyst carrier body. The flange has a second that extends at least partially into an outer wall of the housing and can be disposed between a cylinder head and a manifold of an internal combustion engine. The catalyst carrier configuration can be mounted close to an internal combustion engine. A structural unit having at least two catalyst carrier configurations and an exhaust system are also provided.

U.S. Pat. No. 6,740,178, which issued to Kurth et al. on May 25, 2004, describes a method for producing a centered honeycomb body. The method includes forming a honeycomb body by stacking and/or winding layers of steel sheet containing chromium and aluminum resulting in the honeycomb body having channels through which a fluid can flow. The honeycomb body is introduced into a tubular jacket.

U.S. Pat. No. 6,799,422, which issued to Westerbeke et al. on Oct. 5, 2004, describes an emission control method. It is intended for use with a fixed speed internal combustion engine and includes injecting a controlled flow of air into the exhaust between a first catalyst bed adapted to reduce hydrocarbon and nitrogen oxide emissions and a second catalyst bed adapted to reduce carbon monoxide emissions.

The patents described above are hereby expressly incorporated by reference in the description of the present invention.

SUMMARY OF THE INVENTION

An exhaust system for a marine engine made in accordance with a preferred embodiment of the present invention comprises a plurality of exhaust ports configured to conduct exhaust gas from a plurality of cylinders of the marine engine, an exhaust conduit disposed in serial fluid communication downstream from the plurality of exhaust ports, and a non-catalytic porous member disposed within the exhaust conduit. The system can further comprise a catalyst device disposed in fluid communication between the plurality of exhaust ports and the non-catalytic porous member. The non-catalytic porous member can comprise a metallic mesh material and can be configured to direct exhaust gas through the metallic mesh material. The non-catalytic porous member can comprise a metallic catalytic substrate without a catalyst coating. The non-catalytic porous member is disposed upstream from a location within the exhaust system where exhaust gas is mixed with cooling water. The non-catalytic porous member is disposed in thermal communication with the exhaust gas.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
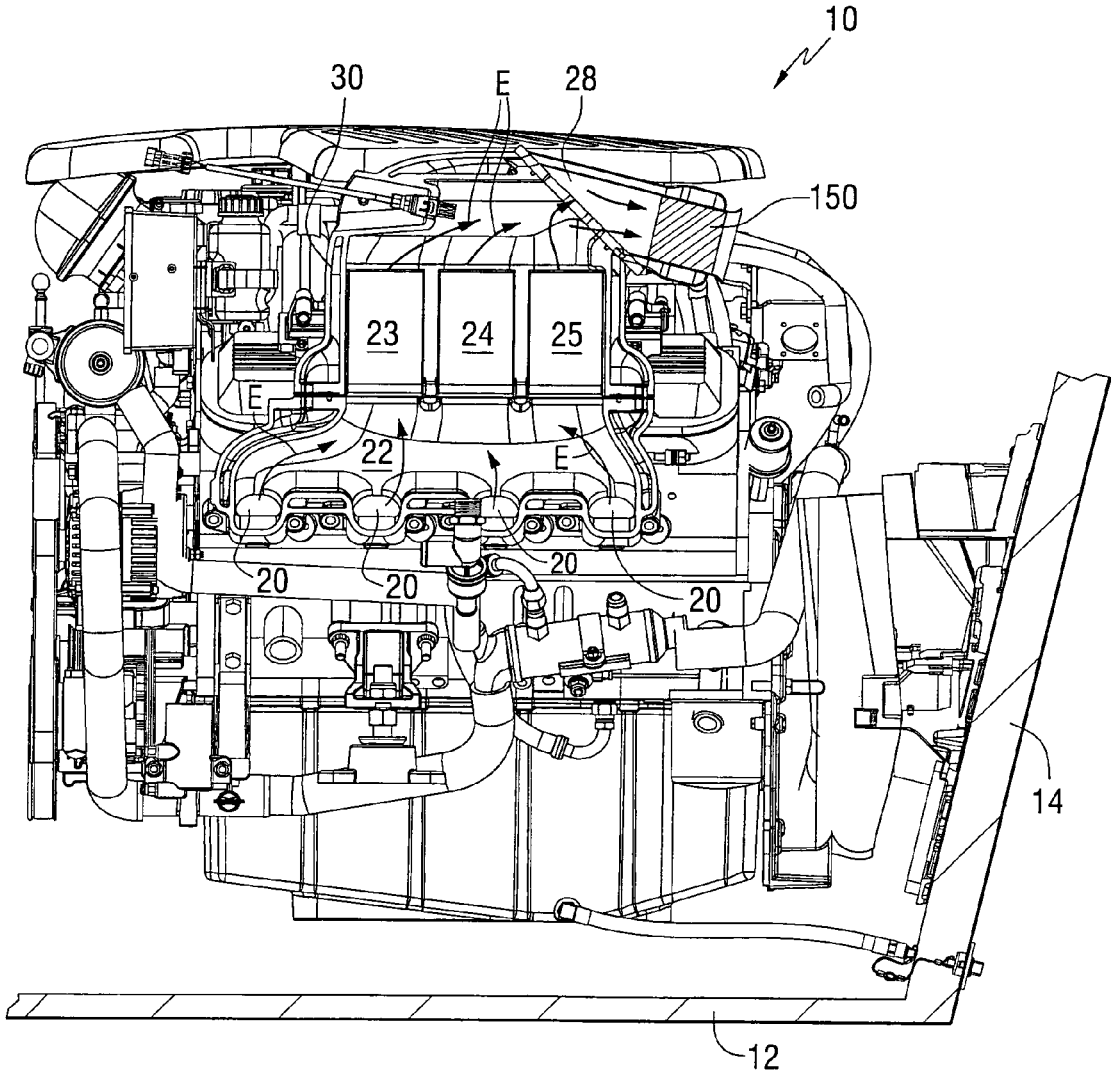
FIG. 1 is a side view of a marine engine which is partially sectioned to show internal portions of the exhaust system.

Throughout the description of the preferred embodiment of the present invention, like components will be identified by like reference numerals. In the following description of various embodiments of the present invention, certain configurations will be described and illustrated as having three catalyst devices used together as a system. It should be clearly understood that the catalyst devices can alternatively be combined together in systems comprising less than or greater than this number. In addition, it should also be clearly understood that certain embodiments of the present invention can comprise a single catalyst device. All of these alternative configurations are described below in relation to an exemplary engine arrangement. In addition, it should be understood that a catalyst system made in accordance with a preferred embodiment of the present invention, when used in conjunction with a V-type engine, would typically be provided at both sides, or cylinder banks, of the engine.

FIG. 1 shows a marine engine 10 within the structure of a marine vessel 12. Although not shown in FIG. 1, the crankshaft of the engine 10 is supported for rotation about a horizontal axis and attached in torque transmitting relation with a driveshaft that extends through the transom 14 to provide motive power to a marine propulsion drive (not shown in FIG. 1). The marine engine 10 has a to plurality of exhaust ports 20 configured to conduct exhaust gas from a plurality of cylinders within the structure of the engine. A first exhaust conduit 22 is disposed in fluid communication with the plurality of exhaust ports 20. The first exhaust conduit 22 performs the function of an exhaust manifold which receives the exhaust gas from the plurality of exhaust ports 20 and directs it away from the engine 10. A plurality of catalyst devices 23-25 is disposed in fluid communication with the first exhaust conduit 22. The plurality of exhaust conduits, as will be described in greater detail below, are configured and arranged in cooperation with the first exhaust conduit 22 to assure that all of the exhaust gas passes through the plurality of catalyst devices 23-25. A second exhaust conduit 28 is disposed in fluid communication with the plurality of catalyst devices 23-25. The catalyst devices are disposed in serial fluid communication between the first and second exhaust conduits, 22 and 28. Each one of the plurality of catalyst devices 23-25 is disposed in parallel fluid communication with each other.

With continued reference to FIG. 1, the first exhaust conduit 22, or exhaust manifold, is disposed in serial fluid communication between the plurality of exhaust ports 20 and the plurality of catalyst devices 23-25. The second exhaust conduit 28 is disposed in serial fluid communication with the plurality of catalyst devices 23-25. The catalyst devices 23-25 are aligned along a common plane. The common plane is generally vertical and extends in a direction which is generally parallel with a crankshaft of the engine 10.

Each of the catalyst devices 23-25, in a particularly preferred embodiment of the present invention, comprises a cylindrical housing. The housing can alternatively be generally tubular and non-cylindrical. A catalyst material is disposed within the generally tubular housing structure of each of the catalyst devices 23-25. A central housing 30, or catalyst housing structure, is provided to retain the catalyst devices 23-25 in their proper positions relative to both the first and second exhaust conduits, 22 and 28. The path of the exhaust gas E is represented by the arrows in FIG. 1. The exhaust gas travels from the plurality of exhaust ports 20, through the first exhaust conduit 22, through the catalyst devices 23-25, and through the second exhaust conduit 28. From there, as is generally understood by those skilled in the art, the exhaust gas is directed away from the engine 10 either through the transom 14 and to an underwater outlet or through exhaust pipes above and to the rear of the engine 10.

With continued reference to FIG. 1, it should be understood that one of the advantages of a preferred embodiment of the present invention is that the use of three catalyst devices 23-25 reduces the overall required size of the components associated with the exhaust system. In other words, three catalyst devices 23-25 of a lesser diameter can be aligned as shown in FIG. 1 in a space that requires less overall width of the engine structure than would be needed if a single circular catalyst device was used. It should be understood that, when the marine engine 10 is a V-type engine, two exhaust systems are provided, one on the port side of the engine as shown in FIG. 1 and a similarly configured exhaust system on the starboard side of the engine.

Figure 2:
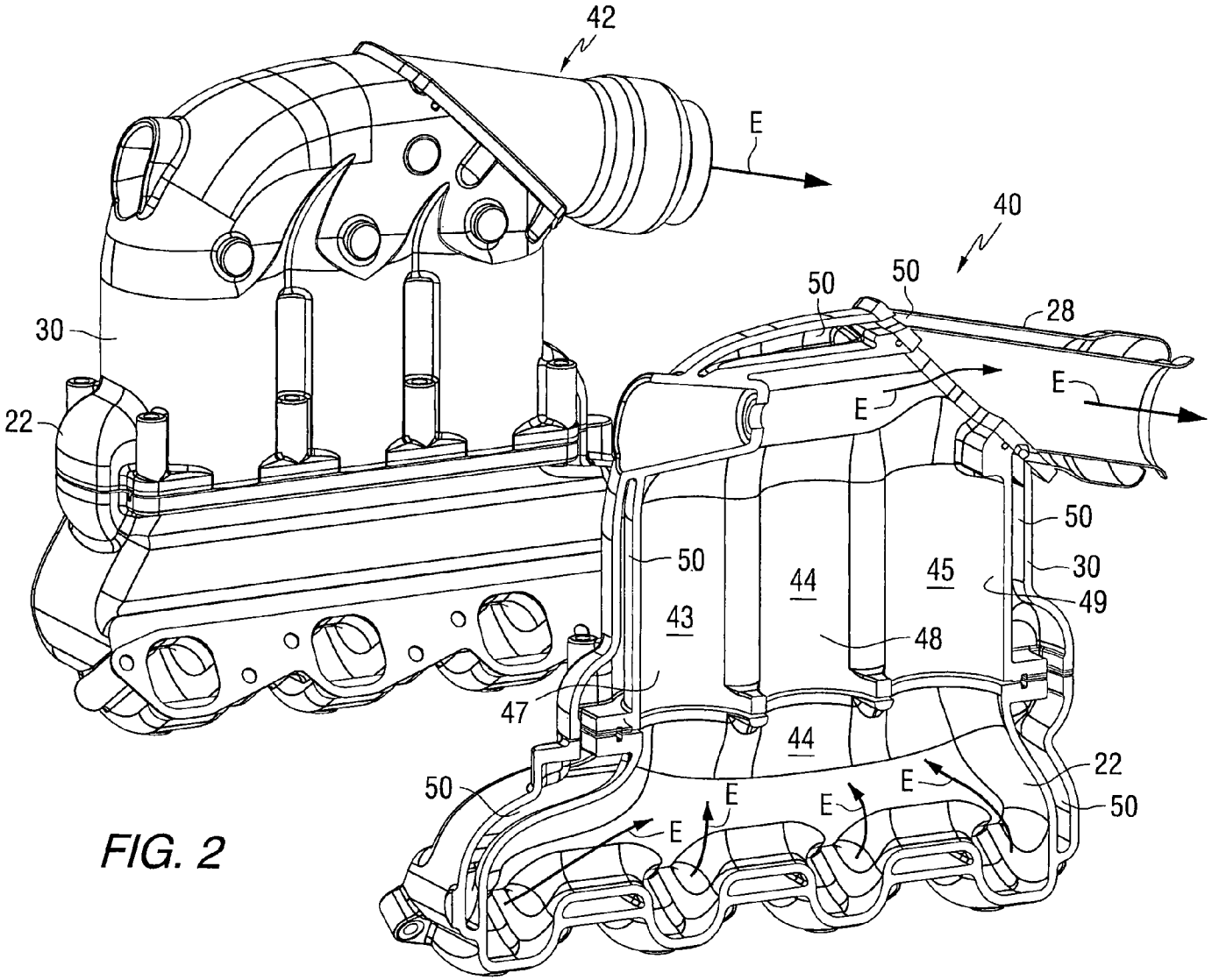
FIG. 2 is an isometric partially sectioned view of the port and starboard exhaust components.

FIG. 2 is an isometric and partially sectioned view of two exhaust structures used in conjunction with one embodiment of the present invention. A port exhaust structure 40 and a starboard exhaust structure 42 are shown in FIG. 2. The port exhaust structure 40 is sectioned to illustrate various internal characteristics. The exhaust manifold, or first exhaust conduit 22, directs the exhaust gas E from exhaust ports of the engine, as described above, through a plenum region 44. The central housing structure 30, or catalyst housing structure, has a plurality of generally tubular cavities 43-45 formed therein. Each of the tubular cavities is shaped to receive one of the catalyst devices 23-25 which are to described above in conjunction with FIG. 1. Those catalyst devices are not shown in FIG. 2. Each of the tubular cavities 43-45 is sized to define a space between an inner surface, such as surfaces 47-49, of the cavities 43-45, respectively, and an outer surface of the generally tubular structure of the catalyst devices 23-25. This generally annular space thus defined by the sizes of the catalyst devices 23-25 and the generally tubular cavities 43-45 provides an important thermally insulative function between the catalyst devices and the catalyst housing structure 30. As shown in FIG. 2, cooling passages 50 are provided to limit the temperature of the first exhaust conduit 22, the catalyst housing structure 30, and the second exhaust conduit 28. However, many types of catalyst devices operate more efficiently and effectively at raised temperatures. Therefore, it can become counterproductive if the catalyst devices 23-25 receive a cooling effect as a result of the water passing through the cooling passages 50. By providing a space between the catalyst devices 23-25 and there respective tubular cavities 43-45, this cooling effect is reduced. As a result of this insulating space, the catalyst devices 23-25 operate at higher temperatures because of the temperature of the exhaust gas E passing through them.

Figure 3:
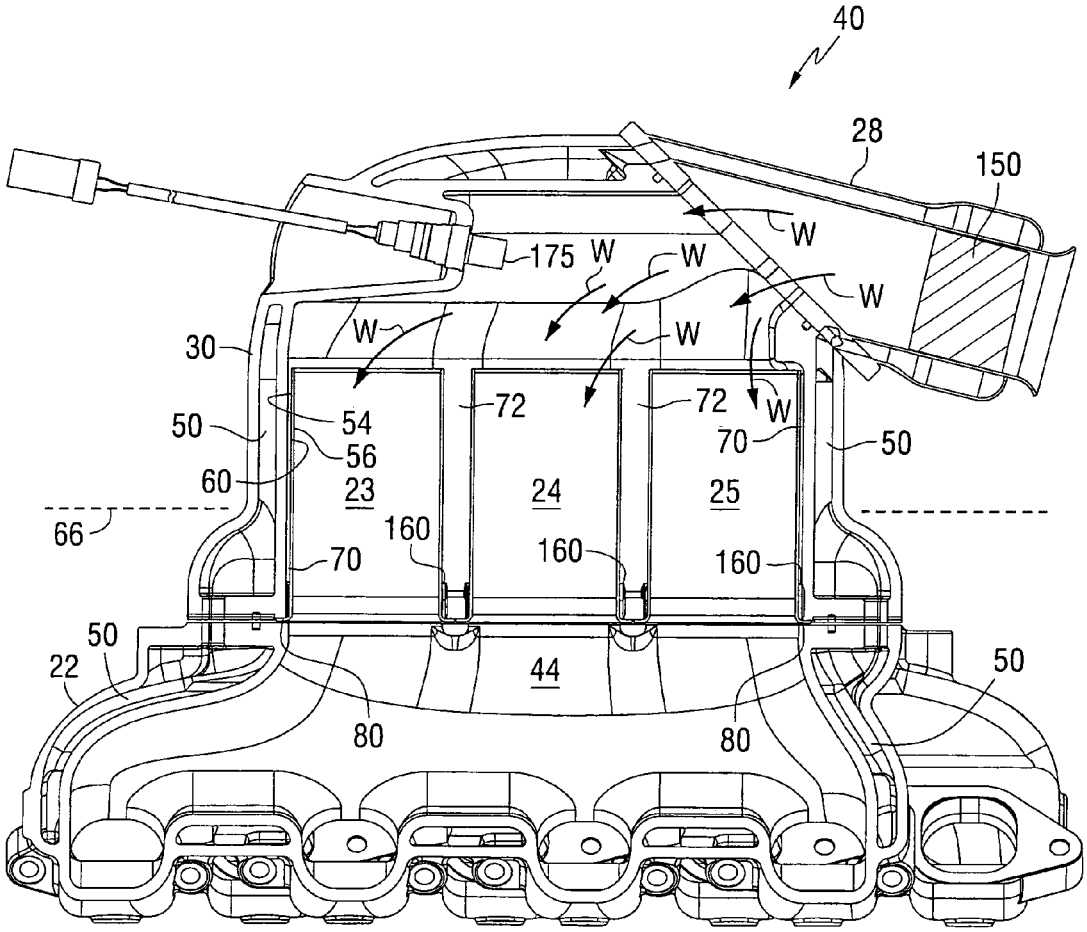
FIG. 3 is a section view of the port exhaust system of a marine engine.

FIG. 3 is a sectioned view of the port exhaust device 40. With particular reference to catalyst device 23 in FIG. 3, it can be seen that the outer surface 54 of the generally tubular member 56 is smaller than the inner surface 60 of the associated tubular cavity which is described above in conjunction with FIG. 2 and identified by reference numeral 43. This difference in size between the outer surface 54 and the inner surface 60 defines the generally annular space 70 surrounding the catalyst device 23. As a result, heat is not efficiently communicated away from the catalyst device 23 toward the inner surface 60 of the tubular cavity which is cooled by the water passages 50. The catalyst devices 23-25 therefore operate at higher temperatures than would be possible if their tubular structures were in direct thermal contact with the inner walls of their associated tubular cavities.

Figure 4:
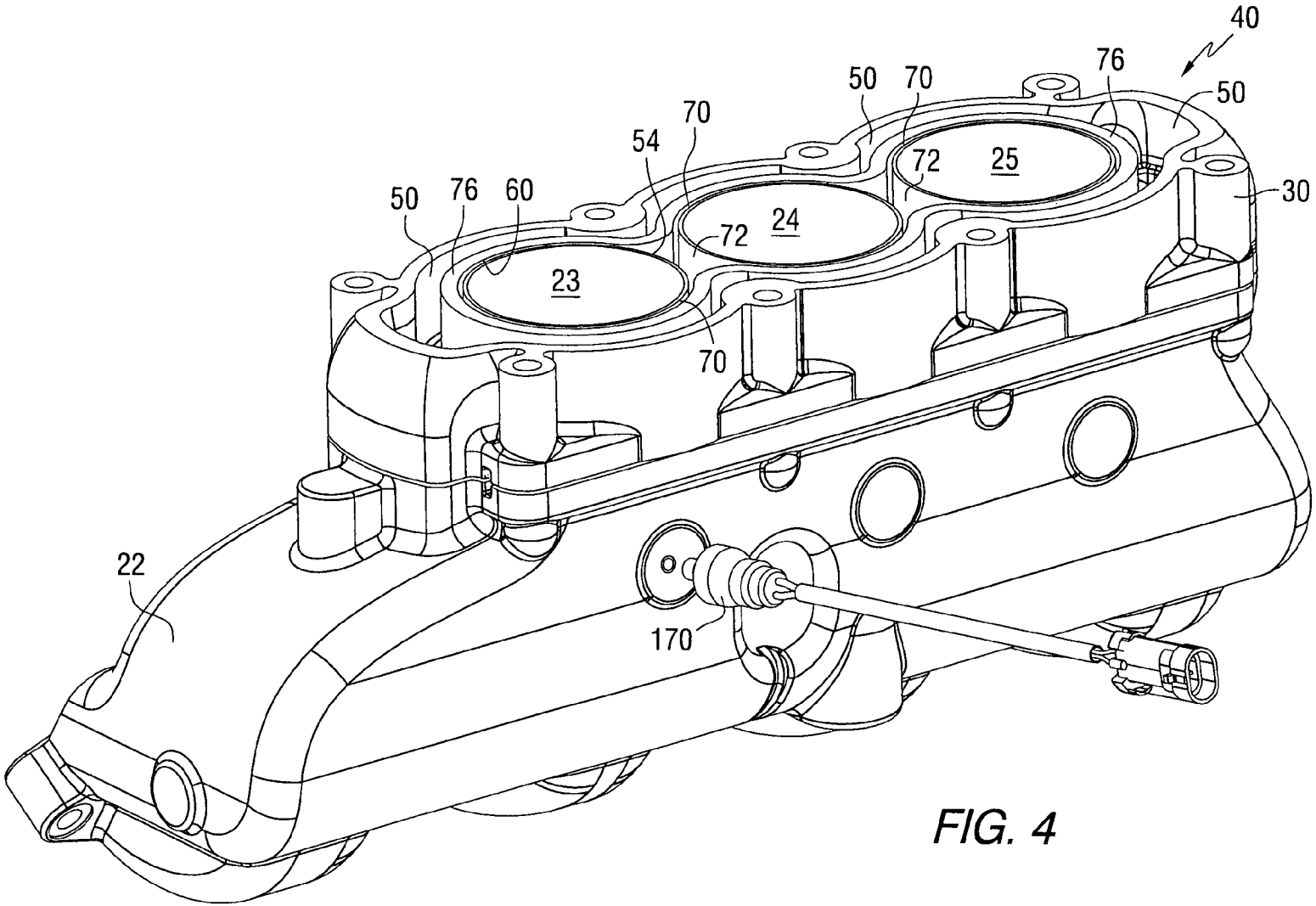
FIG. 4 is a partially sectioned isometric view of the device shown in FIG. 3.

FIG. 4 is a partially sectioned view of the port exhaust device 40. The view of FIG. 4 is a section taken along a plane that is generally horizontal and is intersects the catalyst housing structure 30 and the three catalyst devices 23-25. This plane of intersection is illustrated in FIG. 3 and identified by dashed line 66.

In FIG. 4, the space between the outer surface 54 of the tubular catalyst device and the inner cylindrical surface 60 of the tubular cavity is identified by reference numeral 70. This space is generally annular and circular in cross-section except in the region directly between adjacent catalyst devices 23-25. In that region the space, identified by reference numeral 72, is larger because of the geometry of the components and the fact that adjacent tubular cavities, identified by reference numerals 43-45 in FIG. 2, are not isolated from each other. Also shown in FIG. 4 is a water jacket 50 surrounding the wall 76 that defines the generally tubular cavities 43-45.

Figure 5:
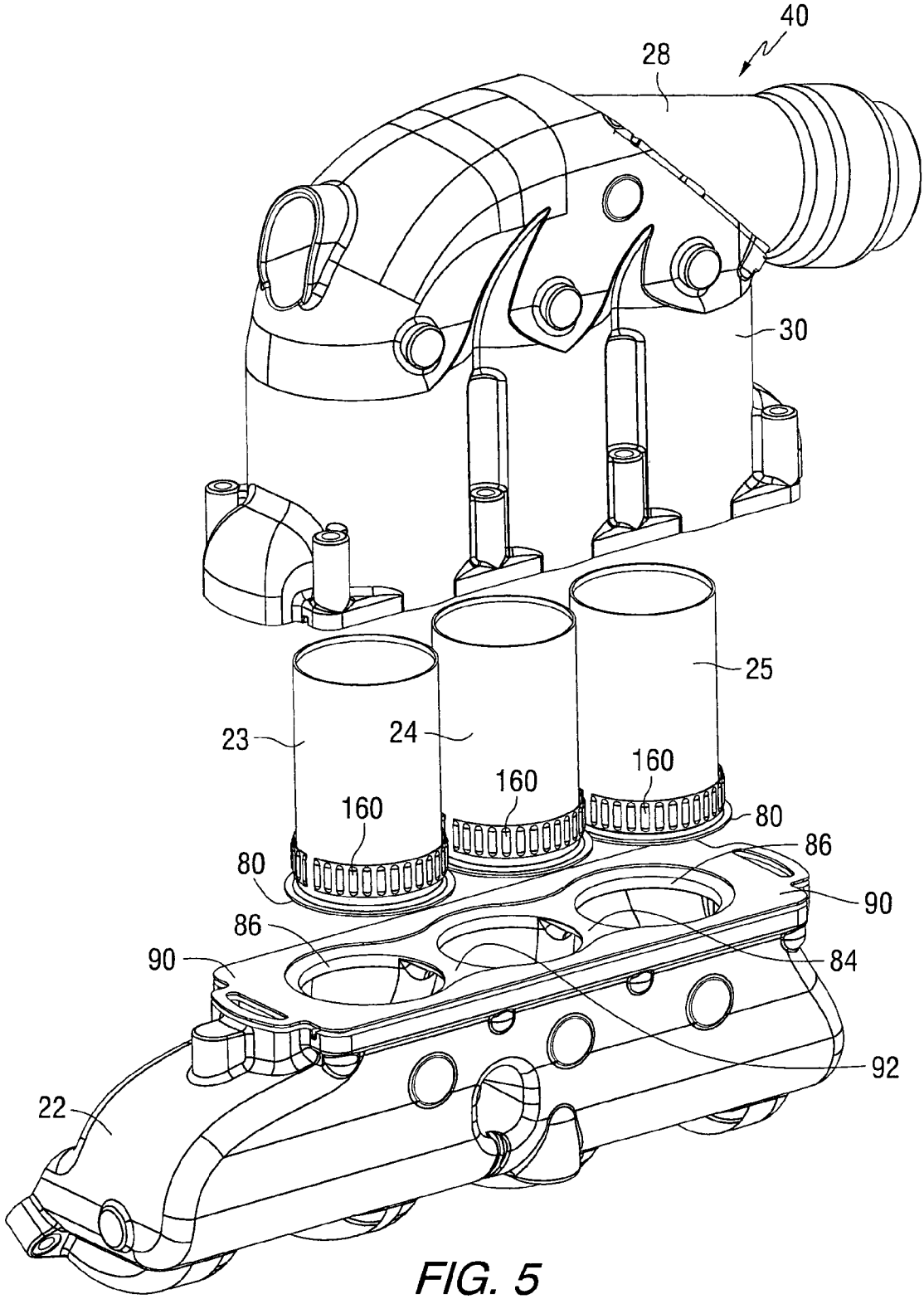
FIG. 5 is an exploded isometric view of the port side exhaust system of the present invention.

FIG. 5 is an isometric view of the port exhaust device 40 with the catalyst housing structure 30 separated to expose the three catalyst devices 23-25. The exploded view of FIG. 5 also shows the catalyst devices 23-25 spaced apart from the first exhaust conduit 22 or exhaust manifold. Several characteristics of the preferred embodiment of the present invention can be seen in the exploded isometric view of FIG. 5. Each of the catalyst devices 23-25 has a tubular portion, which is generally cylindrical in the embodiment shown in FIG. 5, and a rim 80 which is configured to lie in a plane which is generally perpendicular to a central axis of the tubular portion of the catalyst device. These rims 80 are configured to support the associated catalyst device on an upper surface 84 of the first exhaust conduit 22, or exhaust manifold. In other words, the outer diameter of the rim 80 is greater than the inner diameter 86 of an associated opening formed in the upper surface 84 of the exhaust manifold or first exhaust conduit 22. These relative sizes of the openings 86 and rims 80 prevent the catalyst devices 23-25 from passing into the associated opening 86. When the catalyst housing structure 30 is attached to the exhaust manifold 22, the rims 80 of the catalyst devices 23-25 are captured between opposed flange surfaces. Under the rims 80 is the surface identified reference numeral 84 and above the rims 80 is the lower surface of the catalyst housing structure 30. As a result of the space 70 described above in conjunction with FIG. 4, the catalyst devices 23-25 are generally in non-contact association with the catalyst housing structure 30. They are supported by their relationship of the rims 80 with the upper surface 84 of the first exhaust conduit 22 and a lower surface of the catalyst housing structure 30.

With continued reference to FIG. 5, a gasket 90 is disposed on the flange surface 84 of the first exhaust conduit 22. It has a central opening 92 formed therethrough. The central opening 92 formed through the gasket 90 is sized to allow the rims 80 to rest on the surface 84 within the size of the opening 92. In other words, when the catalyst housing structure 30 is attached to the exhaust manifold 22, the rims 80 are in contact with surface 84 and the lower surface of the catalyst housing structure 30, but the gasket 90 is not disposed between the rims 80 and either surface.

With reference to FIGS. 3 and 5, it can be seen that the rims 80 provide a seal at the bottom of the spaces identified by reference numerals 70 and 72 and described above in conjunction with FIG. 4. This seal at the bottom of these spaces inhibits a liquid, such as water, from flowing downward out of the spaces 70 and 72. As such, the seal cooperates with the space to form a reservoir that captures water which may flow along the walls of the catalyst housing structure 30 under the effect of gravity. This water can result from condensation formed on the inner walls of the catalyst housing structure 30. If that condensation occurs, the seal provided by the rims 80 at the bottom portions of the catalyst devices 23-25 inhibits the flow of that water into the exhaust manifold 22 and, eventually, into the exhaust ports of the engine. When the catalyst devices 23-25 reach elevated temperatures, as a result of their direct exposure to the exhaust gas E, the increased temperature will boil the captured water within the reservoir of the spaces 70 and 72 and that resulting water vapor will pass upwardly through the catalyst housing structure 30 and out of the second exhaust conduit 28 with the exhaust gas.

Figure 6:
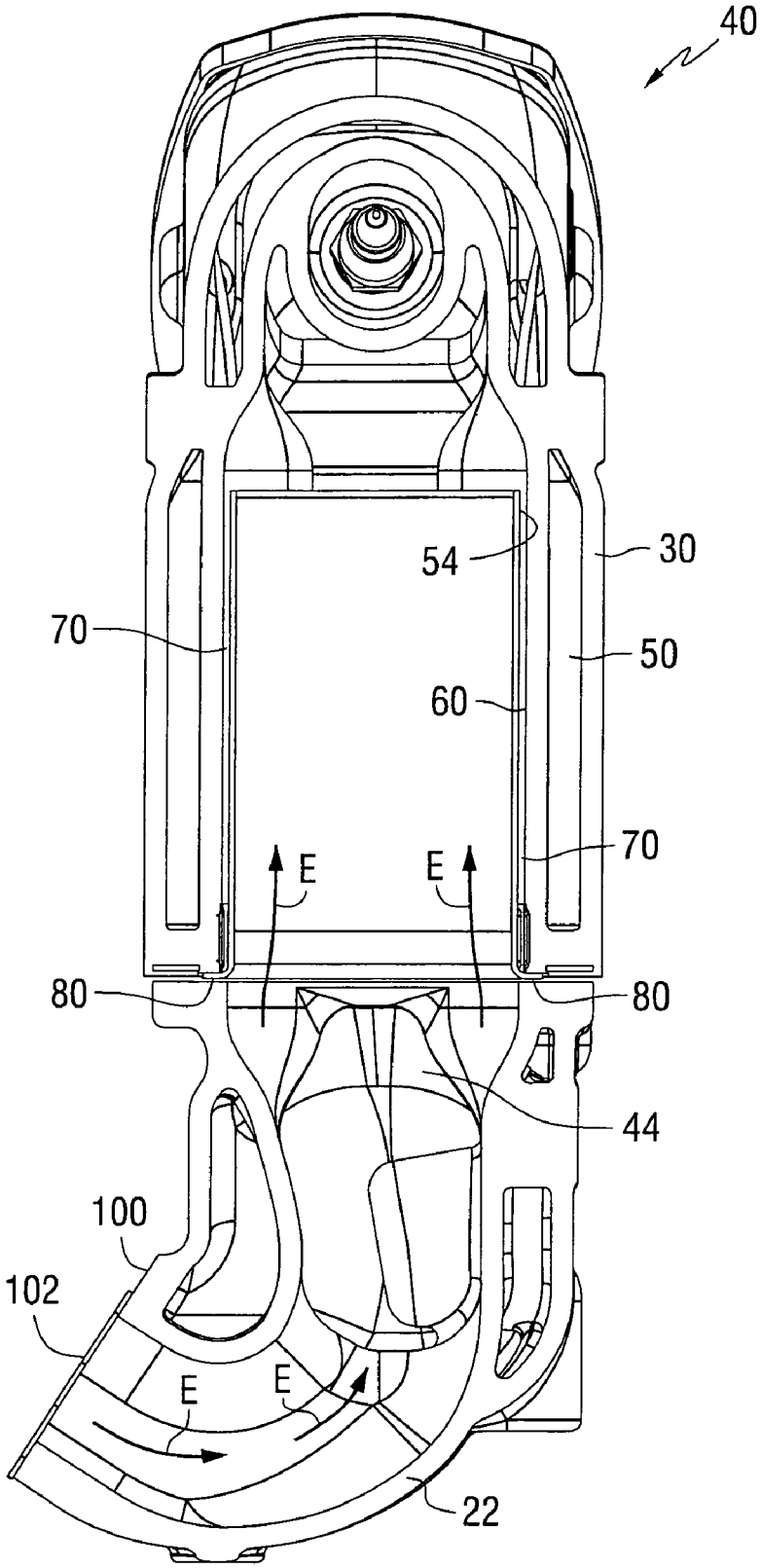
FIG. 6 is a section view of the port side exhaust system of a marine engine.

FIG. 6 is a section view of the exhaust manifold 22, or first exhaust conduit, and the catalyst housing structure 30 attached to it. FIG. 6 also shows the surface 100 of the exhaust manifold which can be rigidly attached to a surface of the engine through which exhaust gas is conducted through its exhaust ports. Reference numeral 102 identifies a gasket between surface 100 of the exhaust manifold 22 and the corresponding surface of the engine surrounding the exhaust ports. The exhaust gas E flows from the exhaust ports of the engine, through the exhaust manifold 22 and through the catalyst devices 23-25 as described above in conjunction with FIGS. 1-5. The space 70 is shown in FIG. 6 surrounding the outer surface 54 of the generally tubular portion of the catalyst device and the inner surface 60 of the generally tubular cavity formed within the catalyst housing structure 30.

Figure 7:
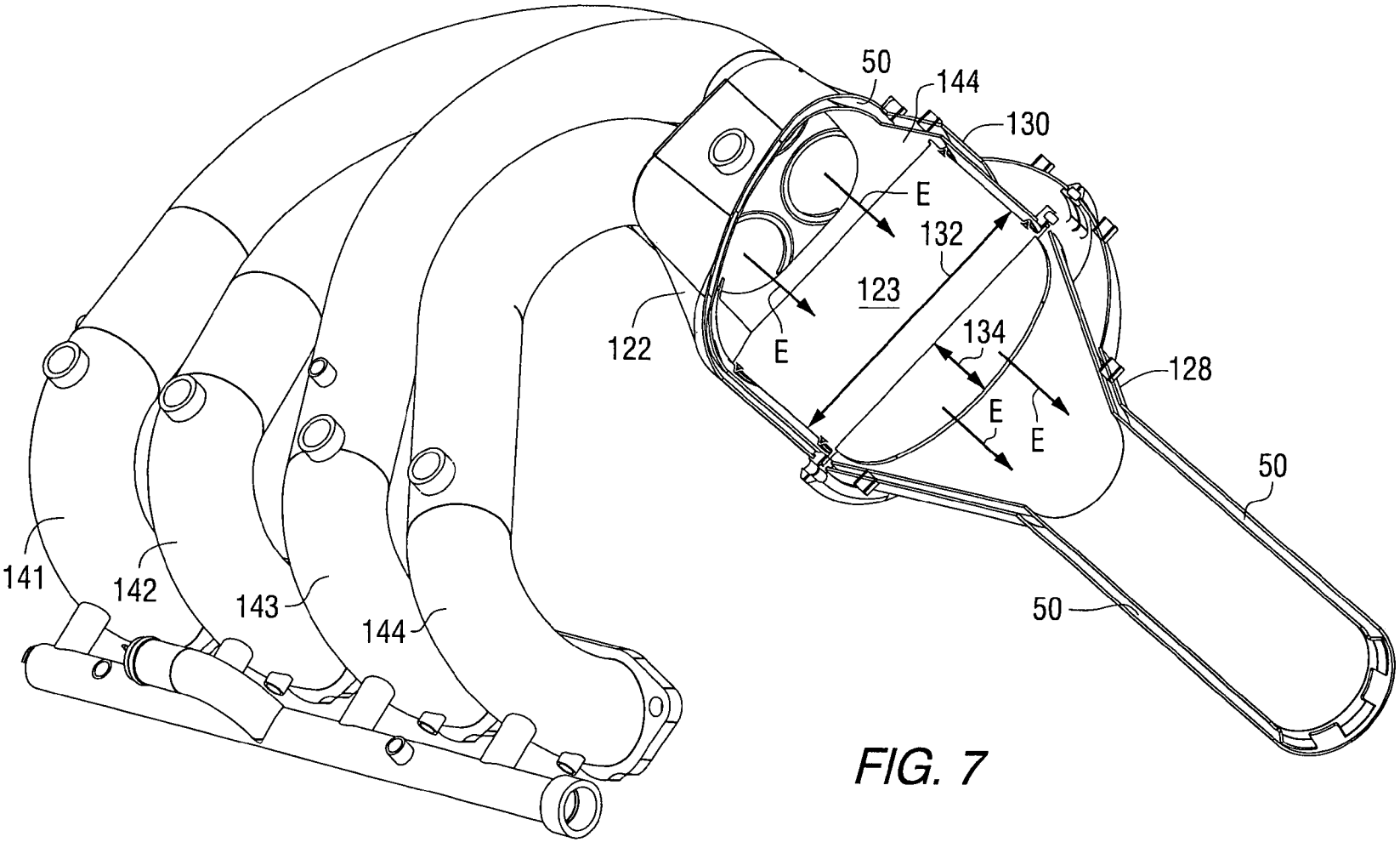
FIG. 7 is an alternative exhaust system using an oblong catalyst device.

Throughout the description of the exhaust system with reference to FIGS. 1-6, the catalyst devices 23-25 have been illustrated and described as being generally cylindrical in cross-section. However, it should be understood that this generally cylindrical shape is not necessary in all embodiments of the present invention. As an example, an oblong-shaped catalyst device can also be used. FIG. 7 shows an oblong-shaped catalyst device 123 disposed within a catalyst housing structure 130. The oblong nature of the catalyst device can be seen from its major axis 132 and the arrow 134 which represents half of its minor axis illustrated in the section view of the catalyst device 123 in FIG. 7. The structure shown in FIG. 7 directs exhaust gas through four pipes 141-144 which conduct the exhaust gas to a plenum region 144 where the exhaust gas from each pipe is free to combine with gas from other pipes within the plenum 144 of the catalyst is housing structure 130. The exhaust gas passes through the plenum 144 and then through the catalyst device 123. After flowing through the catalyst device 123, the exhaust gas E flows into and through the second exhaust conduit 28.

The exhaust system described above in conjunction with FIGS. 1-7 exhibits numerous advantageous characteristics which improve the operation of a marine engine. These characteristics will be described in greater detail below in conjunction with the specific figures that best illustrate those characteristics.

FIG. 7 illustrates the oblong catalyst device 123 and FIG. 1 shows the relative positions of the exhaust ports 20 on the marine engine 10. It should be understood that the generally cylindrical exhaust devices 23-25 could be replaced within the catalyst housing structure 30 by an appropriately shaped oblong catalyst device such as that which is identified by reference numeral 123 in FIG. 7.

With reference to FIGS. 1 and 7, one embodiment of the present invention comprises a plurality of exhaust ports 20, a first exhaust conduit, 22 or 122, an oblong catalyst device 123 and a second exhaust conduit, 28 or 128. The first exhaust conduit 122 is disposed in fluid communication with the plurality of exhaust ports by the exhaust pipes 141-144. The oblong catalyst device 123 is disposed in fluid communication with the first exhaust conduit, 22 or 122. The oblong catalyst 123 has a major axis 132, a minor axis, half of which is represented by arrow 134, and a central axis which extends through the catalyst device in a direction generally parallel to the arrows representing the flow of exhaust gas E. The oblong catalyst device is configured to conduct the exhaust gas E in a direction generally perpendicular to the major and minor axes, 132 and 134, and generally parallel to the central axis. The second exhaust conduit, 28 or 128, is disposed in fluid communication with the oblong catalyst device 123. The oblong catalyst device is disposed in serial fluid communication between the first and second exhaust conduits, 122 and 128.

The configuration of a preferred embodiment of the present invention, described above in conjunction with FIGS. 1-7, promotes a generally uniform flow of exhaust gas through the catalyst module, whether the catalyst module comprises a plurality of catalyst devices 23-25 or whether it comprises a single larger catalyst device 123. With reference to FIGS. 2 and 6, the exhaust gas E flowing into the exhaust manifold 22, or first exhaust conduit, flows from regions of relatively smaller cross-sectional area (e.g. the exhaust ports of the engine) to a plenum area 44 having a greater cross-sectional area. As a result of this increase in cross-sectional area along the path of the exhaust gas E, the velocity of the exhaust gas decreases. This allows the exhaust to more uniformly seek areas of lower pressure along the inlet surfaces of the catalyst devices 23-25. In other words, without the plenum area 44, the exhaust gas stream would be more subject to the influences of gas stream velocity and momentum that could urge the exhaust to flow through limited portions of the inlet area of the catalyst devices. However, when a plenum 44 is provided, the velocity of the gas stream slows and allows the exhaust to more uniformly seek lower pressure areas along the inlet surfaces of the catalyst devices. Rather than directing the exhaust gas stream with a restrictive conduit, the expanded area 44 of the plenum decreases the velocity of the flow and encourages a more uniform distribution of the exhaust gas through the plurality of exhaust devices or, alternatively, through all of the areas of the inlet of a single catalyst device.

With reference to FIGS. 1 and 3, a non-catalytic porous member 150 is disposed within the second exhaust conduit 28. This non-catalyst porous member can be made of the same material used to begin the manufacturing process associated with the catalyst devices 23-25. That manufacturing process is described in U.S. Pat. Nos. 6,368,726 and 6,639,193. U.S. Pat. Nos. 6,660,235 and 6,740,178 also describe the manufacturing process associated with creating a catalyst device. The internal portions of the catalyst devices described in those patents comprise a support structure which is porous. The support structure is also provided with a catalytic material to manufacture a catalyst device. The non-catalytic porous member 150 comprises the internal support structure, but without the catalytic material being included. Its purpose is not to serve as a catalyst device. Its purpose is to serve as a structure which inhibits the flow of liquid water in a reverse direction through the second exhaust conduit 28. Exhaust gas freely passes through the porous non-catalytic member as it flows away from the engine 10. As a result, the non-catalytic porous member is heated to approximately the temperature of the exhaust gas stream. If water attempts to migrate in a reverse direction through the non-catalytic porous member 150, it will be rapidly evaporated and the resulting vapor will be carried away from the engine 10 by the exhaust stream. This embodiment of the present invention provides an exhaust conduit 28 disposed in serial fluid communication downstream from a plurality of exhaust ports 20 as described above. The non-catalytic porous member can comprise a metallic mesh material and it can be configured to direct the exhaust gas through the metallic mesh material. In a preferred embodiment, the non-catalyst porous member comprises a metallic catalytic substrate, but without a catalytic coating.

The embodiment of the present invention described above in conjunction with FIGS. 1-6 comprises a catalyst device (e.g. devices 23-25) that comprises a first catalyst material disposed within a first housing structure, such as the tubular or cylindrical structure illustrated in FIG. 5. The tubular portion of the catalyst devices has a central axis. The rim portion 80 extends from an end of the generally tubular portion and is disposed in a plane which is generally perpendicular to the central axis of the tubular portion. A gasket 90 is disposable between the exhaust manifold 22 and the catalyst housing structure 30. The gasket 90 is disposed between the two flange surfaces which include the upper surface 84 of the exhaust manifold 22 and the lower surface of the catalyst housing structure 30. The gasket has an opening 92 which is formed through its thickness. The opening 92 is configured to receive the rim portion 80 of a catalyst device. The size of the opening 92 is selected to allow the rim portions 80 to be captured between the upper surface 84 of the exhaust manifold 22 and the lower surface of the catalyst housing 30 without the gasket 90 being compressed between the rim portion 80 and either of the two flange surfaces.

As described above in conjunction with FIGS. 3, 4 and 6, the outer surface 54 of each tubular catalyst device 23-25 is shaped to be received within an associated tubular cavity 43-45 with a space 70 therebetween. The space 70 is a generally annular space defined by the difference in size between the outer surface 54 of the catalyst devices 23-25 and the inner surface 60 of the associated tubular cavity. This space 70 provides an effective thermal insulation between the catalyst devices 23-25 and the catalyst housing structure 30. The presence of the rim 80 at the bottom portion of each catalyst device 23-25 provides a seal which prevents liquid from flowing downward and out of the space 70 if liquid is trapped therein. As a result, a reservoir is defined which holds the liquid until the temperature becomes sufficiently high to boil the liquid and allow the water vapor to escape with the gas stream.

With reference to FIG. 5, a concentricity spacer 160 is provided for each of the catalyst devices 23-25. The purpose of the concentricity spacer is to maintain the outer cylindrical surface of the catalyst devices in a concentric relationship with the inner cylindrical surface of the associated tubular cavity 43-45. The concentricity spacer 160, in a preferred embodiment of the present invention, comprises a relatively thin sheet of material that is embossed with raised is portions which maintain the concentricity of the catalyst device and its associated tubular cavity while allowing fluid to flow in a vertical direction past the concentricity spacer.

With reference to FIGS. 3 and 4, two oxygen sensors are illustrated. An upstream oxygen sensor 170 is disposed in fluid communication with the exhaust gas passing through the exhaust manifold 22. A downstream oxygen sensor 175 is disposed in the upper portion of the catalyst housing structure 30.

As shown in FIG. 4, the upstream oxygen sensor 170 is disposed within the overall exhaust structure and, more specifically, within the exhaust manifold 22. It is therefore disposed downstream from the plurality of exhaust ports 20 (shown in FIG. 1) and upstream from the catalyst devices 23-25. The oxygen sensor 170 is configured to remain at or below the temperature of the exhaust gas E when the exhaust gas is flowing from the plurality of exhaust ports 20 as shown in FIG. 1. In other words, the oxygen sensor 170 located upstream from the catalyst devices 23-25 is unheated other than the effect it experiences from the hot exhaust gas flowing over it. The unheated nature of the upstream oxygen sensor 170 provides a significant advantage because it is less susceptible to damage in the event that liquid, such as water condensate, flows in a reverse direction from the second exhaust conduit 28 toward the plurality of exhaust ports of the engine 10. If the upstream oxygen sensor 170 is heated, as most oxygen sensors now are, it could be severely damaged if water flows in contact with it. The use of an unheated oxygen sensor 170 therefore provides a significant benefit in an exhaust system of a marine engine.

FIG. 3 illustrates an advantage provided by the system described herein in conjunction with a reverse flow of liquid, as represented by arrows W, from the second exhaust conduit 28 toward the catalyst devices 23-25. The downstream oxygen sensor 175 is disposed within the catalyst housing structure 30 and in fluid communication with the plurality of exhaust ports 20 described above in conjunction with FIG. 1. It is also disposed in fluid communication with the second exhaust conduit 28. The second exhaust conduit 28 is connected to a first portion of the catalyst housing structure 30 which, as illustrated in FIG. 3, is at the upper right portion of this device. The oxygen sensor 175 is connected to a second portion of the catalyst housing structure 30 which is located at the upper left portion as shown in FIG. 3. In a preferred embodiment of the present invention, the first and second portions are disposed at opposite sides of the catalyst housing structure 30 as shown.

With continued reference to FIG. 3, the first exhaust conduit 22, the catalyst housing structure 30 and the catalyst device 23-25 are configured and arranged to cooperatively define a reversion liquid trajectory path W for water that flows in a direction from the second exhaust conduit 28 toward the first exhaust conduit 22. This reversion liquid trajectory path is governed by the positions of the second exhaust conduit 28 and the catalyst devices 23-25 in conjunction with the resulting inertia of the water droplets as they flow under the effect of differential pressure that can result from the opening of exhaust valves of the engine.

The causes for water reversion are well known to those skilled in the art of marine propulsion systems. As water droplets are caused to flow in a reverse direction, as indicated by arrows W, the trajectory of those water droplets is governed by the magnitude of the differential pressure between the second exhaust conduit 28 and the first exhaust conduit 22 in conjunction with the size of the various droplets, the shape of the internal cavity of the catalyst housing structure 30, and the positions of the upper portions of the catalyst devices 23-25. The location of the downstream oxygen sensor 175 is selected, in a preferred embodiment of the present invention, to be away from this reversion liquid trajectory path illustrated by arrows W in FIG. 3. As such, the water droplets are less likely to strike the downstream oxygen sensor 175. This advantageous location of the downstream oxygen sensor 175 therefore avoids damage that would otherwise occur to it if the hot sensor 175 is struck by water droplets flowing in a reverse direction from the second exhaust conduit 28 toward the catalyst devices 23-25.

Although the present invention has been described in particular detail and illustrated to show various embodiments, it should be understood that alternative embodiments are also within its scope.

We claim:

1. An exhaust system for a marine engine, comprising:

a plurality of exhaust ports configured to conduct exhaust gas from a plurality of cylinders of said marine engine;

an exhaust conduit disposed in serial fluid communication downstream from said plurality of exhaust ports;

a noncatalytic porous member disposed within said exhaust conduit; and wherein said exhaust gas flows in a forward direction through said noncatalytic porous member, and wherein water passing in a reverse direction through said exhaust system is vaporized as it attempts to flow through said noncatalytic porous member.

2. The exhaust system of claim 1, further comprising:

a catalyst device disposed in fluid communication between said plurality of exhaust ports and said noncatalytic porous member.

3. The exhaust system of claim 1, wherein:

said noncatalytic porous member is disposed upstream from a location within said exhaust system where said exhaust gas is mixed with water.

4. The exhaust system of claim 1, wherein:

said noncatalytic porous member comprises a metallic mesh material spanning the entire cross-section of said exhaust conduit without internal baffle walls having openings otherwise passing water therethrough.

5. The exhaust system of claim 4, wherein:

said noncatalytic porous member is configured to direct said exhaust gas through said metallic mesh material.

6. The exhaust system of claim 1, wherein:

said noncatalytic porous member comprises a metallic catalytic substrate without a catalytic coating.

7. The exhaust system of claim 6, wherein:

said noncatalytic porous member is configured to direct said exhaust gas through said metallic catalytic substrate without a catalytic coating.

8. The exhaust system of claim 1, wherein:

said noncatalytic porous member is disposed in thermal communication with said exhaust gas.

9. The exhaust system of claim 8, wherein:

said noncatalytic porous member is disposed upstream from a location within said exhaust system where said exhaust gas is mixed with water.

10. An exhaust system for a marine engine, comprising:

a plurality of exhaust ports configured to conduct exhaust gas from a plurality of cylinders of said marine engine;

an exhaust conduit disposed in serial fluid communication downstream from said plurality of exhaust ports;

a porous noncatalytic metallic member disposed within said exhaust conduit; and wherein said exhaust gas flows in a forward direction through said noncatalytic porous member, and wherein water passing in a reverse direction through said exhaust system is vaporized as it attempts to flow through said noncatalytic porous member.

11. The exhaust system of claim 10, further comprising:

a catalyst device disposed in fluid communication between said plurality of exhaust ports and said porous noncatalytic metallic member.

12. The exhaust system of claim 11, wherein:

said porous noncatalytic metallic member comprises a material being selected from the group consisting of a metallic mesh and a metallic catalytic substrate without a catalytic coating.

13. The exhaust system of claim 12, wherein:

said porous noncatalytic metallic member is configured to direct said exhaust gas through said metallic mesh material.

14. The exhaust system of claim 13, wherein:

said porous noncatalytic metallic member is disposed upstream from a location within said exhaust system where said exhaust gas is mixed with water.

15. The exhaust system of claim 13, wherein:

said porous noncatalytic metallic member is disposed in thermal communication with said exhaust gas.

16. An exhaust system for a marine engine, comprising:

a plurality of exhaust ports configured to conduct exhaust gas from a plurality of cylinders of said marine engine;

an exhaust conduit disposed in serial fluid communication with and downstream from said plurality of exhaust ports;

a noncatalytic porous member disposed within said exhaust conduit, said noncatalytic porous member comprising a material being selected from the group consisting of a metallic mesh and a metallic catalytic substrate without a catalytic coating;

a catalyst device disposed in fluid communication between said plurality of exhaust ports and said noncatalytic porous member; and wherein said exhaust gas flows in a forward direction through said noncatalytic porous member, and wherein water passing in a reverse direction through said exhaust system is vaporized as it attempts to flow through said noncatalytic porous member.

17. The exhaust system of claim 16, wherein:

said noncatalytic porous member is disposed upstream from a location within said exhaust system where said exhaust gas is mixed with water.

18. The exhaust system of claim 16, wherein:

said noncatalytic porous member is configured to direct said exhaust gas through its structure.

19. The exhaust system of claim 18, wherein:

said noncatalytic porous member is disposed upstream from a location within said exhaust system where said exhaust gas is mixed with water.

20. The exhaust system of claim 19, wherein:

said noncatalytic porous member is disposed in thermal communication with said exhaust gas.

* * * * *